US006910861B2

(12) United States Patent
Beyer et al.

(10) Patent No.: US 6,910,861 B2
(45) Date of Patent: Jun. 28, 2005

(54) TURBOMOLECULAR VACUUM PUMP WITH THE ROTOR AND STATOR VANES

(75) Inventors: Christian Beyer, Köln (DE); Heinz Engländer, Linnich (DE); Peter Klingner, Köln (DE); Martin Laerbusch, Langerwehe (DE)

(73) Assignee: Leybold Vakuum GmbH, Cologne (DE)

( * ) Notice: Subject to any disclaimer, the term of this patent is extended or adjusted under 35 U.S.C. 154(b) by 0 days.

(21) Appl. No.: 10/466,343

(22) PCT Filed: Nov. 15, 2001

(86) PCT No.: PCT/EP01/13204

§ 371 (c)(1),
(2), (4) Date: Jul. 11, 2003

(87) PCT Pub. No.: WO02/059483

PCT Pub. Date: Aug. 1, 2002

(65) Prior Publication Data

US 2004/0037695 A1 Feb. 26, 2004

(30) Foreign Application Priority Data

Jan. 25, 2001 (DE) ..... 101 03 230

(51) Int. Cl.[7] ..... F04D 29/54
(52) U.S. Cl. ..... 415/211.2; 416/242
(58) Field of Search ..... 415/90, 199.5, 415/221.2; 416/242–243, 911

(56) References Cited

U.S. PATENT DOCUMENTS

| | | | | |
|---|---|---|---|---|
| 2,484,554 A | * | 10/1949 | Concordia et al. | 416/188 |
| 3,128,939 A | * | 4/1964 | Szydlowski | 416/242 |
| 4,227,855 A | * | 10/1980 | Flynn et al. | 415/218.1 |
| 4,653,976 A | * | 3/1987 | Blair et al. | 415/1 |
| 6,499,942 B1 | * | 12/2002 | Nonaka et al. | 415/90 |

FOREIGN PATENT DOCUMENTS

| | | |
|---|---|---|
| DE | 72 37362 | 1/1973 |
| EP | 0 829 645 A2 | 3/1998 |
| EP | 1 004 775 A2 | 5/2000 |
| GB | 1019272 | 2/1966 |

* cited by examiner

*Primary Examiner*—Edward K. Look
*Assistant Examiner*—Dwayne J. White
(74) *Attorney, Agent, or Firm*—Fay, Sharpe, Fagan, Minnich & McKee, LLP

(57) ABSTRACT

A turbomolecular vacuum pump (1) has an inlet (3) and an outlet (4) and rotor and stator vanes (5 and 6), situated between the inlet and outlet. The rotor vanes (6) have front sides (11) and rear sides (12) in relation to the direction of rotation. At least a part of the rotor vanes (6) have a rear side (12) which is convex on the suction-side and concave on the delivery side. Alternately, at least part of the rotor vanes (6) have a front side (11), which is concave on the suction side and convex on the delivery side.

11 Claims, 2 Drawing Sheets

TURBOMOLECULAR VACUUM PUMP WITH THE ROTOR AND STATOR VANES

BACKGROUND OF THE INVENTION

The present invention relates to turbomolecular vacuum pumps.

Turbomolecular vacuum pumps are designed similar to turbines, with stator vanes and rotor blades. A significant pumping action is only obtained in the range of molecular flow ($p<10^{-3}$ mbar). In the Knudsen flow range which then follows, pumping performance is reduced more and more at increasing pressure.

The pumping principle of a turbomolecular vacuum pump is based on the effect that the gas molecules which are to be pumped, obtain an impulse in the direction of the pumping action by impact with the rotor blades and stator vanes. This effect is only obtained when the circumferential velocities of the rotor blades are in the order of magnitude of the mean thermal velocity of the gas molecules to be pumped.

The mean thermal velocity of gas molecules is dependent on their molar mass. For $H_2$ (mass 2) it amounts to approximately 1760 m/s and for nitrogen (mass 28) to approximately 470 m/s. From these figures and is apparent that the pumping properties of a turbomolecular vacuum pump are dependent on the type of gas. This not so much applies to the pumping capacity, but all the more to the compression ratio (ratio between the partial pressure of the gas component on the delivery side of the turbomolecular vacuum pump and the partial pressure of this gas component on the high vacuum side of this pump). The compression ratio of a known turbomolecular vacuum pump increases between the masses of the aforementioned gases $H_2$ and $N_2$from approximately $10^3$ to $10^8$.

The common embodiment of the blades of a turbomolecular pump is known from DE-U 72 37 362. These exhibit flat boundary surfaces. Their angle of attack (angle between the plane of the blades and a plane perpendicular to the rotational axis) increases from the suction side of the pump towards the delivery side.

From EP-A-829 645 it is known to employ rotor blades, the boundary surfaces of which are no longer flat. It is proposed to design the rear side (with respect to their direction of rotation) in a curved manner. Thus turbulences which impose a strain on the drive motor and which occur in the instance of rotor blades with flat boundary surfaces on the rear, shall be avoided.

It is the task of the present invention to improve the pumping properties of a turbomolecular vacuum pump for gases having a low specific mass.

The present application solves these problems and others.

SUMMARY OF THE INVENTION

The application improves the pumping of lighter gases. Moreover, the benefit is obtained impairing the compression and pumping performance of the pump (compression, pumping capacity, throughput) for gases having a higher molar mass. Finally, blades and the vanes designed in accordance with the present invention maintain their improved pumping properties far into the Knudsen range, so that the forevacuum tolerance of a turbomolecular pump equipped with such blades or vanes is, compared to the state-of-the-art, far more favorable. The complexity for the forevacuum pumps can be reduced significantly.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
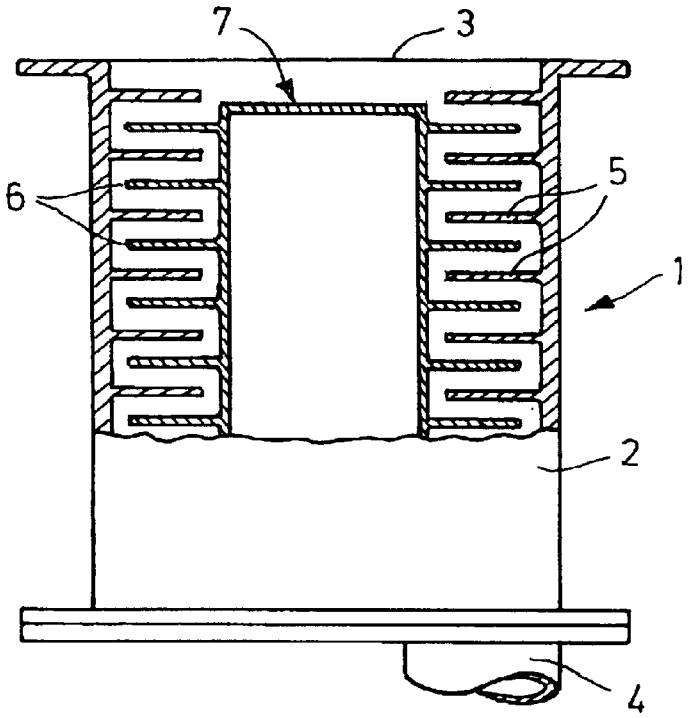
FIG. 1 is the schematic of a turbomolecular vacuum pump.

The turbomolecular vacuum pump 1 depicted in FIG. 1 comprises a housing/stator 2, an inlet 3, an outlet 4, stator vanes 5 and rotor blades 6. In a known manner not specifically detailed, the stator vanes 5 are components of rows of stator vanes which are joined to the housing/stator 2. The rotor blades 6 are components of rows of rotor blades which are affixed at rotating body 7, for example a shaft, or which are designed as a single piece with said rotating body. The rows of rotor blades and stator vanes engage alternately with opposing angles of attack and effect pumping of the gases from the inlet 3 to the outlet 4.

Depicted in FIGS. 2 to 5 are various embodiments of blades/vanes designed in accordance with the present invention (developed view). The upper edge 8 depicted in the Figures faces, in each instance, the suction side of the pump 1, and the bottom edge 9 in each instance faces in the delivery side. Depicted are, in each instance, sections through the blades/vanes 5, 6 specifically approximately perpendicular to the substantially radially oriented longitudinal axes of the blades/vanes. In parallel to these longitudinal axes of the blades/vanes there extend—as depicted in each instance—the convex and/or concave areas of the front and rear sides. The direction of rotation of the blades 6 is in each instance marked by an arrow 10.

Figure 2:
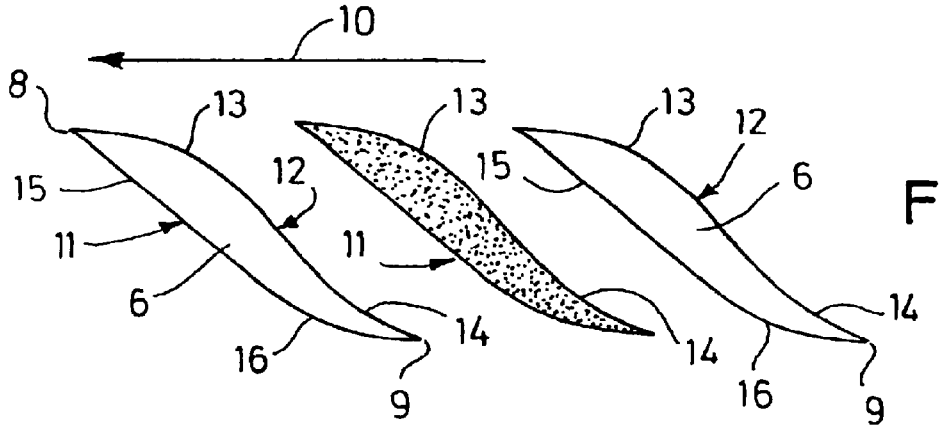
FIGS. 2 and 3 are embodiments of rotor blades designed in accordance with the present invention, where either the rear side or the front side exhibit convex or concave areas, as well as FIGS. 4 and 5 are embodiments of blades and vanes designed in accordance with the present invention, having convex and concave areas on both sides.
Figure 3:
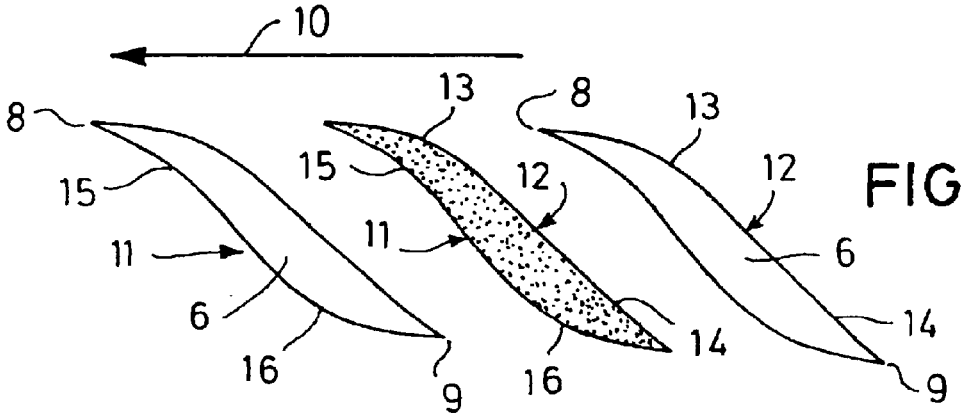

FIGS. 2 and 3 depict examples of embodiments for rotor blades 6, the front sides of which are designated as 11 and the rear sides as 12. In the embodiment in accordance with FIG. 2, the rear sides 12 of the blades 6 exhibit on the suction side a convex area 13 and on the delivery side a concave area 14. The front side 11 is designed to be in the area 15 of its suction side (incoming flow) flat, in area 16 of its pressure side (outgoing flow) convex.

In the embodiment in accordance with FIG. 3, the front sides i of the blades 6 exhibit concave (suction side) and convex (delivery side) areas 15 respectively 16; whereas, the rear sides 12 are designed to be on the suction side convex (area 13) and on the delivery side flat (area 14). The front and the rear boundary surfaces approach each other on the suction side and the delivery side at a sharp angle, thus forming the edges 8, 9 of the vanes.

Figure 4:
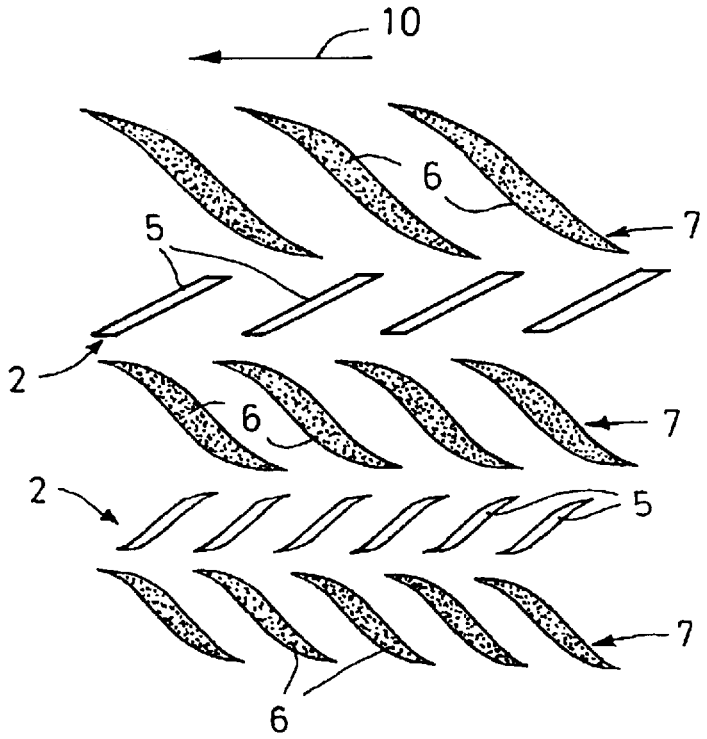

FIG. 4 depicts—also by way of a developed view—an embodiment with three rows of rotor blades 6 being components of the rotor system 7, as well as two rows of stator vanes 5 which are components of the stator 2. The rotor blades 6 are all designed in such a manner that they exhibit on the front and rear sides concave and convex areas respectively (see also FIG. 5). The rows of stator vanes 5 of the upper row of stator vanes the exhibit flat front and rear sides in the known manner; whereas, the stator vanes 5 of the bottom row of vanes are designed in accordance with the present invention. Here the cross-section of the stator vanes 5 are designed such that they are substantially mirror images with respect to the adjacent rotor vanes, i.e. exhibit opposing angles of attack.

Figure 5:
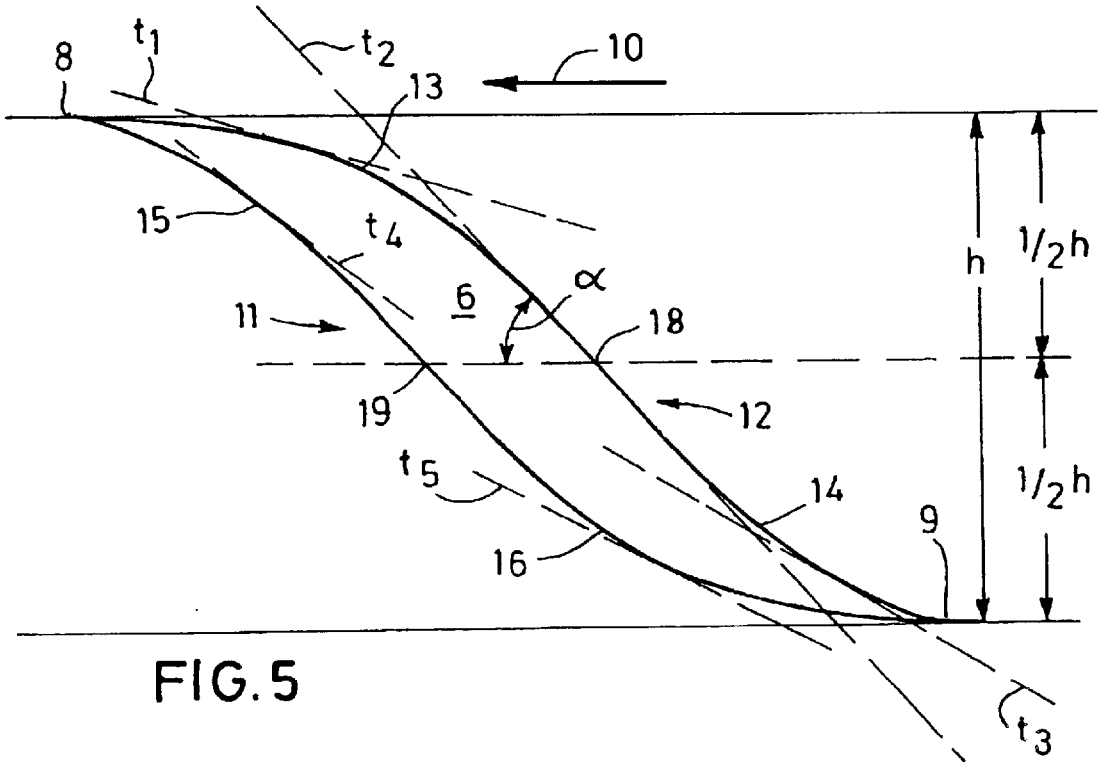

In FIG. 5, a blade 6 is depicted by way of an enlarged view. Some tangents $t_1$ to $t_5$ are depicted. From this it is apparent that already every blade 6 has practically a multitude of angles of attack. In contrast to this, in the instance of the state-of-the-art, the angle of attack only changes from stage to stage. In the preferred embodiments, the radii of the concave and convex areas are so selected that the tangents at all times exhibit positive angles of attack.

The tangent $t_2$ is a tangent through the inflection point 18 of the rear boundary surface of blade 6. Also drawn in, is the (axial) height h of the blade 6. The inflection point 18—and thus also the inflection point 19 of the forward boundary surface 11—is located at half of the height h of the blade 6. The tangent $t_2$ has the angle of attack $\alpha$, which—as in the instance of the state-of-the-art—may decrease from the suction side to the delivery side. Correspondingly, also the stator vanes 5 are expediently designed as mirror images. The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A turbomolecular vacuum pump comprising:

an inlet;

an outlet;

rotor blades and stator vanes situated between the inlet and outlet, the rotor blades having front sides and rear sides in relation to the direction of rotation thereof and suction sides and delivery sides in relation to the inlet and the outlet, the rotor blades rear sides being convex on the suction side and concave on the delivery side.

2. The turbomolecular pump according to claim 1, wherein the front sides of the rotor blades are flat on the suction side and convex on the delivery side.

3. A turbomolecular vacuum pump with an inlet and an outlet and rotor blades and stator vanes situated between the inlet and outlet, the rotor blades having front sides and rear sides in relation to the direction of rotation thereof, at least a part of the rotor blades exhibiting a front side which is concave on a suction side and convex on a delivery side.

4. The turbomolecular pump according to claim 3, wherein the rear side of the rotor blades is convex on the suction side and flat on the delivery side.

5. The turbomolecular vacuum pump comprising:

an inlet;

an outlet;

rotor blades and stator vanes situated between the inlet and outlet, the rotor blades having front sides and rear sides in relation to a direction of rotation thereof and a suction side and a delivery side in relation to the inlet and the outlet, the rotor blades having at least one of:

rear sides which have a convex portion at the suction side and a concave portion at the delivery side, and front sides have a concave portion at the suction side and a convex portion at the delivery side.

6. The turbomolecular pump according to claim 5 wherein the front side and the rear side have boundary surfaces of the blades which approach each other at pointed angles at the suction and delivery sides.

7. The turbomolecular pump according to claim 5, wherein radii of the concave and convex portions have tangents that exhibit positive angles of attack.

8. The turbomolecular pump according to claim 6, wherein the boundary surfaces have inflection points located at half a height of the blades.

9. The turbomolecular pump according to claim 8, wherein a tangent through the inflection point has an angle of attack which decreases from the suction side to the delivery side.

10. The turbomolecular pump according to claim 1, wherein the rotor blades front sides are concave on the suction side and convex on the delivery side.

11. The turbomolecular pump according to claim 8 wherein:

the tangent through the inflection point defines an angle relative to a plane of rotation that is greater than both (1) an angle defined by a tangent to the rear side convex portion relative to the plane of rotation and (2) an angle defined by a tangent to the rear side concave portion relative to the plane of rotation.

* * * * *